US006622944B1

(12) United States Patent
Hurley et al.

(10) Patent No.: US 6,622,944 B1
(45) Date of Patent: Sep. 23, 2003

(54) FUEL OIL ATOMIZER AND METHOD FOR DISCHARGING ATOMIZED FUEL OIL

(75) Inventors: John F. Hurley, Easton, CT (US); Scott H. Lindemann, Oxford, CT (US); John N. Dale, Stratford, CT (US)

(73) Assignee: Combustion Components Associates, Inc., Monroe, CT (US)

( * ) Notice: Subject to any disclaimer, the term of this patent is extended or adjusted under 35 U.S.C. 154(b) by 132 days.

(21) Appl. No.: 09/838,872

(22) Filed: Apr. 20, 2001

(51) Int. Cl.[7] ..... B05B 7/08

(52) U.S. Cl. ..... 239/426; 239/492; 239/552; 239/559; 239/560; 239/561

(58) Field of Search ..... 239/403, 405, 239/406, 418, 419, 419.3, 422, 423, 424.5, 426, 427, 431, 434, 434.5, 466, 467, 470, 472, 492, 494, 496, 552, 554, 555, 558, 559, 560, 561, 567

(56) References Cited

U.S. PATENT DOCUMENTS

| | | | | |
|---|---|---|---|---|
| 1,062,714 A | * | 5/1913 | Johnston | 239/427 |
| 2,933,259 A | * | 4/1960 | Raskin | 239/419 |
| 3,913,845 A | | 10/1975 | Tsuji | |
| 3,923,465 A | * | 12/1975 | Krejci | 239/423 |
| 4,383,649 A | | 5/1983 | Reed | |
| 4,644,879 A | | 2/1987 | Grethe et al. | |
| 4,699,587 A | * | 10/1987 | Shimoda et al. | 239/427 |
| 5,593,298 A | | 1/1997 | Hurley | |
| 5,685,706 A | | 11/1997 | Hersh | |
| 5,826,798 A | | 10/1998 | Schindler | |
| 5,860,600 A | | 1/1999 | Schindler | |
| 6,024,301 A | | 2/2000 | Hurley | |

FOREIGN PATENT DOCUMENTS

| | | |
|---|---|---|
| EP | 0 652 403 | 5/1995 |
| FR | 2.013.573 | 4/1970 |
| WO | WO 95/07761 | 3/1995 |

OTHER PUBLICATIONS

1. Combustion Components Associates, Inc., Atomizer Design Drawing No. 2X120–101–3–80, Mar. 5, 1996 (1 page).
2. Combustion Components Associates, Inc., Low NOx Spray Plate Design Drawing No. 2X105–101–29–80, Feb. 1992 (1 page).
3. Combustion Components Associates, Inc., Waltham Unit #3 Mix Spray Plate Design Drawing No. 2X120–101–3–65, Sep. 14, 1994 (1 page).

* cited by examiner

*Primary Examiner*—Michael Mar
*Assistant Examiner*—Dinh Q Nguyen
(74) *Attorney, Agent, or Firm*—Barry R. Lipsitz; Douglas M. McAllister

(57) ABSTRACT

A two phase fuel oil atomizer utilizing a secondary media such as high pressure steam or air to assist in the atomization of heavy fuel oil, while reducing NOx and other polluting emissions. The fuel oil atomizer comprises a mixing plate and a sprayer plate which are configured to discharge atomized fuel oil at varying spray angles in order to provide staging of the atomized fuel as it exits the sprayer plate with the surrounding combustion chamber air to provide a fuel/air ratio that is appropriately rich and lean in order to allow lower flame temperatures. NOx generation is accordingly reduced at the lower flame temperatures. With atomized fuel droplet size small enough to enable rapid fuel evaporation and complete combustion, low CO, opacity and particulate generation are achieved with minimum excess oxygen.

45 Claims, 4 Drawing Sheets

FUEL OIL ATOMIZER AND METHOD FOR DISCHARGING ATOMIZED FUEL OIL

BACKGROUND OF THE INVENTION

The present invention relates generally to the combustion of fuel oil, and more particularly to the atomization of fuel oil in a combustion furnace. In particular, the present invention provides apparatus and methods for discharging atomized fuel which provide low levels of air pollution emissions, such as oxides of nitrogen (NOx), carbon monoxide (CO), particulate matter (PM) and opacity while operating at low excess oxygen levels for improved efficiency.

For environmental and economical reasons, there is an ongoing need to improve the efficiency of fuel oil atomizers which supply fuel oil to a furnace. In particular, it is well known that "heavy" fuel oil (e.g., heavy number 6 oil or "bunker" oil), which contains organically bound nitrogen and sulfur compounds and has a high asphaltene content, is difficult to combust while producing low air polluting emissions. Particulate matter (PM) in the form of ash and unburned carbon, carbon monoxide (CO) or partially oxidized carbon, oxides of nitrogen (NOx), and opacity are in particular troublesome air emissions for many furnaces burning heavy oil. It is known that the formation of $NO_x$ can be reduced by providing fuel-rich and fuel-lean zones in the atomizing spray pattern.

It would be advantageous to provide apparatus and methods for atomizing fuel oil which reduce NOx emissions, while also improving or maintaining CO, PM and opacity generation. It would be particularly advantageous to provide for the discharge of atomized fuel oil into a combustion chamber with effective fuel spray droplet breakup and both circumferential and radial fuel to air ratio staging in order to lower peak flame temperature and reduce NOx emissions. It would be even further advantageous to provide for the atomized fuel oil droplets discharged into the combustion chamber to be of such a sufficiently small diameter to enable rapid fuel evaporation and complete combustion for low CO emission and thorough carbon burnout with low excess oxygen levels. The methods and apparatus of the present invention provide the above-mentioned and other advantages

SUMMARY OF THE INVENTION

The present invention relates to a fuel oil atomizer and methods for discharging atomized fuel oil, e.g., into a combustion chamber of a furnace. In particular, the present invention relates to a two phase fuel oil atomizer which utilizes a secondary media such as high pressure steam or air to assist in the atomization of fuel oil, such as heavy fuel oil, while reducing NOx and other polluting emissions.

In an exemplary embodiment of the invention, a fuel oil atomizer comprises a mixing plate and a sprayer plate. The mixing plate may have a plurality of distributor openings for receiving a first material (e.g., fuel) and a plurality of central openings for receiving a second material (e.g., an atomizing media). It should be appreciated that the distributor openings can be adapted to receive either fuel or the atomizing media, with the central openings adapted to receive the other of either fuel or the atomizing media. The atomizing media may be high pressure steam or air, or any other suitable atomizing media.

The sprayer plate is adapted to engage the mixing plate in order to force the first material to mix with the second material. The sprayer plate may have an enclosed mixing chamber formed by the mixing plate and a cavity of the sprayer plate for mixing the first material traveling through the mixing plate with the second material traveling through the mixing plate. A plurality of sprayer plate openings may extend through a semi-spherical outer wall of the sprayer plate to enable atomized fuel to be expelled from the mixing chamber. The plurality of sprayer plate openings may be arranged on at least one annulus of the outer wall of the sprayer plate for expelling the atomized fuel at an at least one spray angle.

There may be at least two sets of sprayer plate openings provided. Each set of sprayer plate openings may have respective dimensions and may be arranged on respective annuli of the outer wall of the sprayer plate for expelling atomized fuel at respective spray angles. The respective dimensions of each set of openings may be successively smaller dimensions. The respective annuli may be successively smaller annuli. The respective spray angles may be successively smaller spray angles.

In an alternate embodiment, the plurality of sprayer plate openings may comprise four sets of openings. A first set of openings may have a first dimension and may be arranged on an first annulus of the outer wall of the sprayer plate for expelling atomized fuel at a first spray angle. A second set of openings may have a second dimension and may be arranged on a second annulus of the outer wall of the sprayer plate for expelling atomized fuel at a second spray angle. A third set of openings may have a third dimension and may be arranged on a third annulus of the outer wall of the sprayer plate for expelling atomized fuel at a third spray angle. A fourth set of openings may have a fourth dimension and may be arranged on a fourth annulus of the outer wall of the sprayer plate for expelling atomized fuel at a fourth spray angle.

The first dimension, second dimension, third dimension and fourth dimension may be successively smaller dimensions. The first annulus, second annulus, third annulus, and fourth annulus may be arranged on successively smaller annuli of the outer wall. The first spray angle, second spray angle, third spray angle, and fourth spray angle may be successively smaller spray angles.

In a further embodiment, the first set of openings may comprise two series of equally spaced openings, one series of openings arranged at a top portion of the first annulus and the other series of openings arranged at a bottom portion of the first annulus. The second set of openings may comprise two series of equally spaced openings, one series of openings arranged at a top portion of the second annulus and the other series of openings arranged at a bottom portion of the second annulus. The third set of openings may comprise two series of equally spaced openings, one series of openings arranged at a top portion of the third annulus and the other series of openings arranged at a bottom portion of the third annulus. The fourth set of openings may comprise two series of equally spaced openings, one series of openings arranged at a top portion of the fourth annulus and the other series of openings arranged at a bottom portion of the fourth annulus.

The first spray angle of the first set of openings may be in the range of approximately 80 to 90 degrees. The second spray angle of the second set of openings may be approximately 60 degrees. The third spray angle of the third set of openings may be approximately 40 degrees. The fourth spray angle of the fourth set of openings may be approximately 20 degrees.

Each series of openings of the first set of openings may have a first total angular separation. Each series of openings of the second set of openings may have a second total angular separation. Each series of openings of the third set of openings may have a third total angular separation. The first total angular separation may be approximately 105 degrees. The second total angular separation may be approximately 26 degrees. The third total angular separation may be approximately 36 degrees. Each series of openings of the fourth set of openings may comprise a single opening.

The first set of openings may comprise approximately 66% of total hole flow area of the sprayer plate. The second set of openings may comprise approximately 20% of the total hole flow area of the sprayer plate. The third set of openings may comprise approximately 10% of the total hole flow area of the sprayer plate. The fourth set of openings may comprise approximately 4% of the total hole flow area of the sprayer plate.

The mixing chamber may preferably have a chamber length to chamber diameter ratio in the range of about 0.75:1 to 1.25:1.

The mixing plate may further comprise a plurality of metering slots arranged on an inner portion of the mixing plate and coupling the distributor openings with the central openings.

As discussed above, the first material may be fuel oil and the second material may be an atomizing media, such as steam or air. In such a configuration, the total geometric area ratio of all central openings to all metering slots is preferably in a range from about 0.6:1 to 0.8:1. In the alternative, the first material may be an atomizing media and the second material may be fuel oil. In such a configuration, the total geometric area ratio of all central openings to all metering slots is preferably in a range of about 1.2:1 to 1.7:1.

The total area ratio of all distributor openings to all metering slots is preferably at least 1.7:1. However, the total area ratio of all distributor openings to all metering slots should be at least 1.7:1 and not greater than approximately 3:1.

In an alternate embodiment, the plurality of distributor openings may be arranged on an outer annulus of the mixing plate and may extend through the mixing plate. The plurality of central openings may be arranged on an inner annulus of the mixing plate and may extend through the mixing plate. The plurality of metering slots couple the outer annulus with the inner annulus.

In a preferred embodiment, the fuel oil atomizer comprises a mixing plate and a sprayer plate. The mixing plate may have an outer portion and an inner portion. A plurality of distributor openings may be arranged on an outer annulus of the mixing plate and may extend through the mixing plate. A plurality of central openings may be arranged on an inner annulus of the mixing plate and may extend through the mixing plate. A plurality of metering slots may be arranged on the inner portion of the mixing plate and couple the outer annulus with the inner annulus. The sprayer plate in the preferred embodiment may have a first wall for engaging a portion of the inner portion of the mixing plate such that a first material traveling through the distributor openings is forced into the metering slots for mixture with a second material traveling through the central openings. The sprayer plate may also have a semi-spherical outer wall extending from the first wall and forming a cavity. A plurality of sprayer plate openings extending through the outer wall of the sprayer plate may also be provided to enable atomized fuel to be expelled from the sprayer plate openings. The plurality of sprayer plate openings may comprise four sets of openings.

A first set of openings may have a first dimension and may be arranged on an first annulus of the outer wall of the sprayer plate for expelling atomized fuel at a first spray angle. A second set of openings may have a second dimension and may be arranged on a second annulus of the outer wall of the sprayer plate for expelling atomized fuel at a second spray angle. A third set of openings may have a third dimension and may be arranged on a third annulus of the outer wall of the sprayer plate for expelling atomized fuel at a third spray angle. A fourth set of openings may have a fourth dimension and may be arranged on a fourth annulus of the outer wall of the sprayer plate for expelling atomized fuel at a fourth spray angle.

In the preferred embodiment, an enclosed mixing chamber is formed by the mixing plate and the sprayer plate cavity for mixing the first material traveling through the distributor openings with the second material traveling through the central openings.

In addition, the first dimension, second dimension, third dimension and fourth dimension may be successively smaller dimensions. The first annulus, second annulus, third annulus, and fourth annulus may be arranged on successively smaller annuli of the sprayer plate outer wall. The first spray angle, second spray angle, third spray angle, and fourth spray angle may be successively smaller spray angles.

The four sets of openings provided in the preferred embodiment may each comprise two series of openings. The first set of openings may comprise two series of equally spaced openings, one series of openings arranged at a top portion of the first annulus and the other series of openings arranged at a bottom portion of the first annulus. The second set of openings may comprise two series of equally spaced openings, one series of openings arranged at a top portion of the second annulus and the other series of openings arranged at a bottom portion of the second annulus. The third set of openings may comprise two series of equally spaced openings, one series of openings arranged at a top portion of the third annulus and the other series of openings arranged at a bottom portion of the third annulus. The fourth set of openings may comprise two series of equally spaced openings, one series of openings arranged at a top portion of the fourth annulus and the other series of openings arranged at a bottom portion of the fourth annulus.

Each series of openings of the first set of openings may have a first total angular separation. Each series of openings of the second set of openings may have a second total angular separation. Each series of openings of the third set of openings may have a third total angular separation. Each series of openings of the fourth set of openings may have a fourth total angular separation.

A sprayer plate for use with a mixing plate to atomize fuel oil is provided having a first wall adapted to engage the mixing plate to force a first material to mix with a second material. A cavity of the sprayer plate forms an enclosed mixing chamber when the first wall is engaged with the mixing plate for mixing the first material with the second material. A plurality of sprayer plate openings extend through a semi-spherical outer wall of the sprayer plate to enable atomized fuel to be expelled from the mixing chamber. The plurality of sprayer plate openings may be arranged on at least one annulus of the outer wall of the sprayer plate for expelling the atomized fuel at an at least one spray angle.

For example, at least two sets of the sprayer plate openings may be provided, each set having respective dimensions and being arranged on respective annuli of the outer wall of the sprayer plate for expelling atomized fuel at respective spray angles. The respective dimensions of each set of openings may be successively smaller dimensions. The respective annuli may be successively smaller annuli. The respective spray angles may be successively smaller spray angles.

The plurality of sprayer plate openings may comprise four sets of openings. A first set of openings may have a first dimension and may be arranged on a first annulus of the outer wall of the sprayer plate for expelling atomized fuel at a first spray angle. A second set of openings may have a second dimension and may be arranged on a second annulus of the outer wall of the sprayer plate for expelling atomized fuel at a second spray angle. A third set of openings may have a third dimension and may be arranged on a third annulus of the outer wall of the sprayer plate for expelling atomized fuel at a third spray angle. A fourth set of openings may have a fourth dimension and may be arranged on a fourth annulus of the outer wall of the sprayer plate for expelling atomized fuel at a fourth spray angle.

The first dimension, second dimension, third dimension and fourth dimension may be successively smaller dimensions. The first annulus, second annulus, third annulus, and fourth annulus may be arranged on successively smaller annuli of the outer wall. The first spray angle, second spray angle, third spray angle, and fourth spray angle may be successively smaller spray angles.

The first set of sprayer plate openings may comprise two series of equally spaced openings, one series of openings arranged at a top portion of the first annulus and the other series of openings arranged at a bottom portion of the first annulus. The second set of openings may comprise two series of equally spaced openings, one series of openings arranged at a top portion of the second annulus and the other series of openings arranged at a bottom portion of the second annulus. The third set of openings may comprise two series of equally spaced openings, one series of openings arranged at a top portion of the third annulus and the other series of openings arranged at a bottom portion of the third annulus. The fourth set of openings may comprise two series of equally spaced openings, one series of openings arranged at a top portion of the fourth annulus and the other series of openings arranged at a bottom portion of the fourth annulus.

The first spray angle of the first set of openings may be in the range of approximately 80 to 90 degrees. The second spray angle of the second set of openings may be approximately 60 degrees. The third spray angle of the third set of openings may be approximately 40 degrees. The fourth spray angle of the fourth set of openings may be approximately 20 degrees.

Each series of openings of the first set of openings may have a first total angular separation. Each series of openings of the second set of openings may have a second total angular separation. Each series of openings of the third set of openings may have a third total angular separation. The first total angular separation may be approximately 105 degrees. The second total angular separation may be approximately 26 degrees. The third total angular separation may be approximately 36 degrees. Each series of openings of the fourth set of openings may comprise a single opening.

The first set of openings may comprise approximately 66% of total hole flow area of the sprayer plate. The second set of openings may comprise approximately 20% of the total hole flow area of the sprayer plate. The third set of openings may comprise approximately 10% of the total hole flow area of the sprayer plate. The fourth set of openings may comprise approximately 4% of the total hole flow area of the sprayer plate.

The mixing chamber may have a chamber length to chamber diameter ratio in the range of about 0.75:1 to 1.25:1.

A mixing plate for use with a sprayer plate for atomizing fuel oil is provided. A plurality of distributor openings may be arranged on an outer annulus of the mixing plate and may extend through the mixing plate. A plurality of central openings may be arranged on an inner annulus of the mixing plate and may extend through the mixing plate. A plurality of metering slots may be arranged on an inner portion of the mixing plate and may couple the outer annulus with the inner annulus. The inner portion of the mixing plate is adapted to engage the sprayer plate such that a first material traveling through the distributor openings is forced through the metering slots to mix with a second material traveling through the central openings.

The total area ratio of all distributor openings to all metering slots is preferably at least 1.7:1. However, the total area ratio of all distributor openings to all metering slots may be at least 1.7:1 and not greater than 3:1.

The metering slots may be formed by wedge shaped portions of the inner portion of the mixing plate. The wedge shaped portions may have a larger dimension at the outer annulus than at the inner annulus.

The first material (traveling through the distributor openings and the metering slots) may be fuel. The second material traveling through the central openings may be an atomizing media. In such a configuration, the total geometric area ratio of all central openings to all metering slots may be in a range from about 0.6:1 to 0.8:1.

Where the first material is an atomizing media and the second material is fuel, the total geometric area ratio of all central openings to all metering slots may be in a range of about 1.2:1 to 1.7:1.

A method for discharging atomized fuel oil is also provided. Fuel oil is mixed with an atomizing media in a mixing chamber to produce atomized fuel. The atomized fuel is expelled from the mixing chamber through a plurality of sprayer plate openings. These sprayer plate openings extend through a semi-spherical outer wall of the mixing chamber, and may be arranged on at least one annulus of the outer wall of the mixing chamber for expelling the atomized fuel at an at least one spray angle.

The atomized fuel may be expelled from the plurality of sprayer plate openings at a variety of spray angles. The atomized fuel may be expelled in a spray pattern having distinct rich and lean fuel zones.

The atomized fuel may be expelled from at least two sets of the sprayer plate openings, each set having respective dimensions and being arranged on respective annuli of the outer wall of the mixing chamber.

The plurality of sprayer plate openings may comprise four sets of openings. A first set of openings may have a first dimension and may be arranged on an first annulus of the outer wall of the sprayer plate for expelling atomized fuel at a first spray angle. A second set of openings may have a second dimension and may be arranged on a second annulus of the outer wall of the sprayer plate for expelling atomized fuel at a second spray angle. A third set of openings may have a third dimension and may be arranged on a third annulus of the outer wall of the sprayer plate for expelling atomized fuel at a third spray angle. A fourth set of openings may have a fourth dimension and may be arranged on a fourth annulus of the outer wall of the sprayer plate for expelling atomized fuel at a fourth spray angle.

The first dimension, second dimension, third dimension and fourth dimension may be successively smaller dimensions. The first annulus, second annulus, third annulus, and fourth annulus may be arranged on successively smaller annuli of the outer wall. The first spray angle, second spray angle, third spray angle, and fourth spray angle may be successively smaller spray angles.

The first set of openings may comprise two series of equally spaced openings, one series of openings arranged at a top portion of the first annulus and the other series of openings arranged at a bottom portion of the first annulus. The second set of openings may comprise two series of equally spaced openings, one series of openings arranged at a top portion of the second annulus and the other series of openings arranged at a bottom portion of the second annulus. The third set of openings may comprise two series of equally spaced openings, one series of openings arranged at a top portion of the third annulus and the other series of openings arranged at a bottom portion of the third annulus. The fourth set of openings may comprise two series of equally spaced openings, one series of openings arranged at a top portion of the fourth annulus and the other series of openings arranged at a bottom portion of the fourth annulus.

The first spray angle of the first set of openings may be in the range of approximately 80 to 90 degrees. The second spray angle of the second set of openings may be approximately 60 degrees. The third spray angle of the set plurality of openings may be approximately 40 degrees. The fourth spray angle of the fourth plurality of openings may be approximately 20 degrees.

Each series of openings of the first set of openings may have a first total angular separation. Each series of openings of the second set of openings may have a second total angular separation. Each series of openings of the third set of openings may have a third total angular separation.

The first total angular separation may be approximately 105 degrees. The second total angular separation may be approximately 26 degrees. The third total angular separation may be approximately 36 degrees. Each series of openings of the fourth set of openings may comprise a single opening.

The first set of openings may comprise approximately 66% of total hole flow area of the sprayer plate. The second set of openings may comprise approximately 20% of the total hole flow area of the sprayer plate. The third set of openings may comprise approximately 10% of the total hole flow area of the sprayer plate. The fourth set of openings may comprise approximately 4% of the total hole flow area of the sprayer plate.

DETAILED DESCRIPTION OF THE INVENTION

The present invention relates to a two phase fuel oil atomizer which utilizes a secondary media such as high pressure steam or air to assist in the atomization of fuel oil, such as heavy fuel oil, while reducing NOx and other polluting emissions. The fuel oil atomizer comprises a mixing plate and a sprayer plate which are configured to discharge atomized fuel oil at varying spray angles in order to provide staging of the atomized fuel as it exits the sprayer plate with the surrounding combustion chamber air to provide a fuel/air ratio that is appropriately rich and lean in order to allow lower flame temperatures. NOx generation is accordingly reduced at the lower flame temperatures. With atomized fuel droplet size small enough to enable rapid fuel evaporation and complete combustion, minimum CO and particulate generation is achieved with a minimum excess oxygen level required. This low oxygen level also prevents the conversion of organically bound fuel nitrogen to NOx emissions compared to a conventional atomizer, without any adverse impact (often improving) emissions of CO, particulates, and opacity. Discharged atomized fuel oil droplets are small enough in size to completely burn and thus maintain particulate emissions at a minimum level. Corresponding methods are provided.

Figure 1:
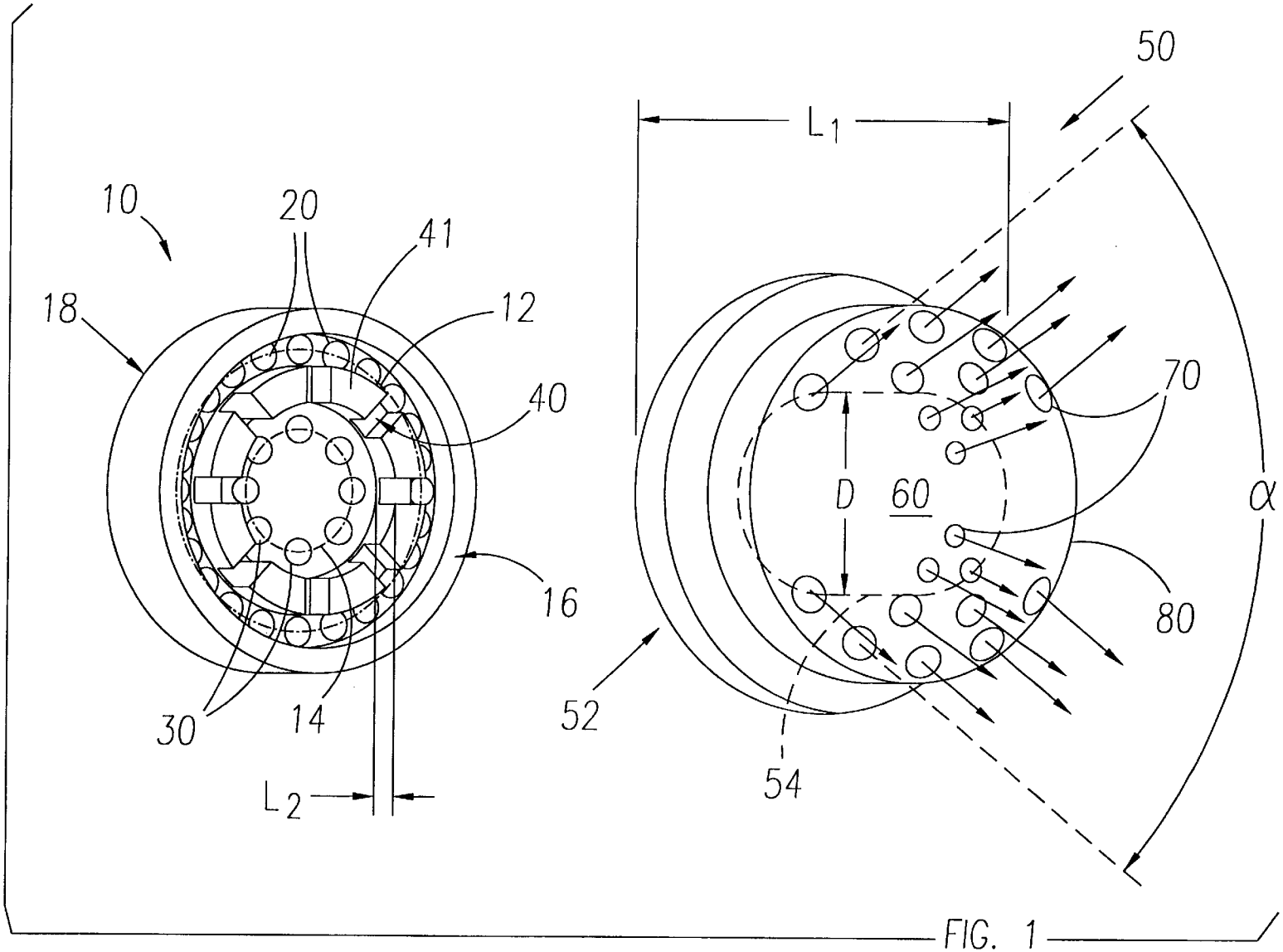
FIG. 1 shows an exemplary perspective view of a mixing plate and sprayer plate for a fuel oil atomizer of the present invention.

In an exemplary embodiment of the invention as shown in FIG. 1, a fuel oil atomizer comprises a mixing plate 10 and a sprayer plate 50. The mixing plate 10 may have a plurality of distributor openings 20 for receiving a first material (e.g., fuel) and a plurality of central openings 30 for receiving a second material (e.g., an atomizing media). It should be appreciated that the distributor openings 20 can be adapted to receive either fuel or the atomizing media, with the central openings 30 adapted to receive the other of either fuel or the atomizing media. The atomizing media may be high pressure steam or air, or any other suitable atomizing media.

The sprayer plate 50 is adapted to engage the mixing plate 10 in order to force the first material to mix with the second material. The sprayer plate 50 has an enclosed mixing chamber 60 formed by the mixing plate 10 and a cavity 54 of the sprayer plate 50 for mixing the first material traveling through the mixing plate 10 with the second material traveling through the mixing plate 10. A plurality of sprayer plate openings 70 extend through a semi-spherical outer wall 80 of the sprayer plate 50 to enable atomized fuel to be expelled from the mixing chamber 60. The plurality of sprayer plate openings 70 are arranged on at least one annulus of the outer wall 80 of the sprayer plate 50 for expelling the atomized fuel at an at least one spray angle $\alpha$.

There may be at least two sets of sprayer plate openings 70 provided. Each set of sprayer plate openings 70 has respective dimensions and is arranged on respective annuli of the outer wall 80 of the sprayer plate 50 for expelling atomized fuel at respective spray angles $\alpha$. The respective dimensions of each set of openings 70 may be successively smaller dimensions. The respective annuli may be successively smaller annuli. The respective spray angles $\alpha$ may be successively smaller spray angles.

Figure 2:
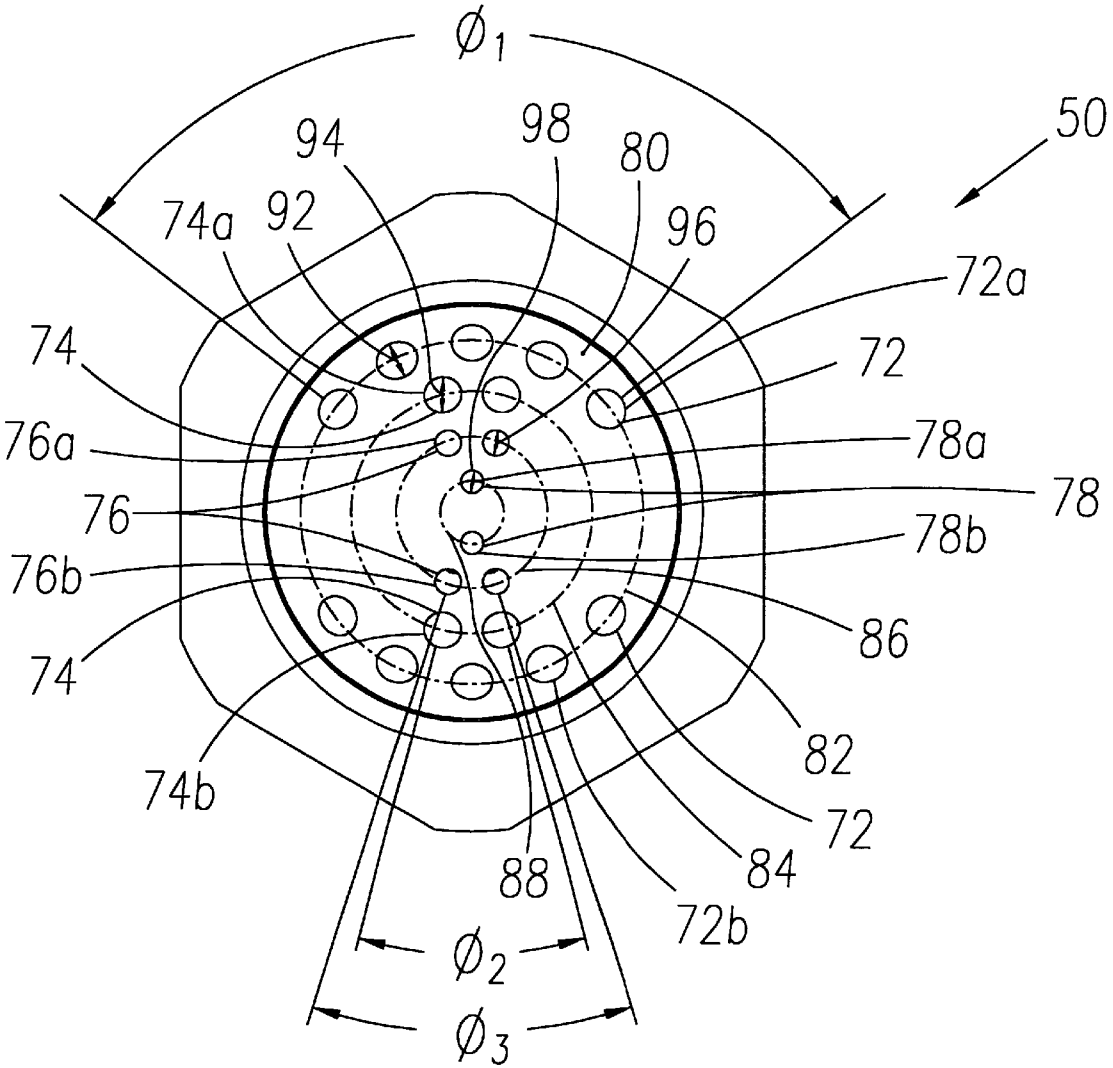
FIG. 2 shows an example embodiment of the sprayer plate of the present invention.
Figure 3:
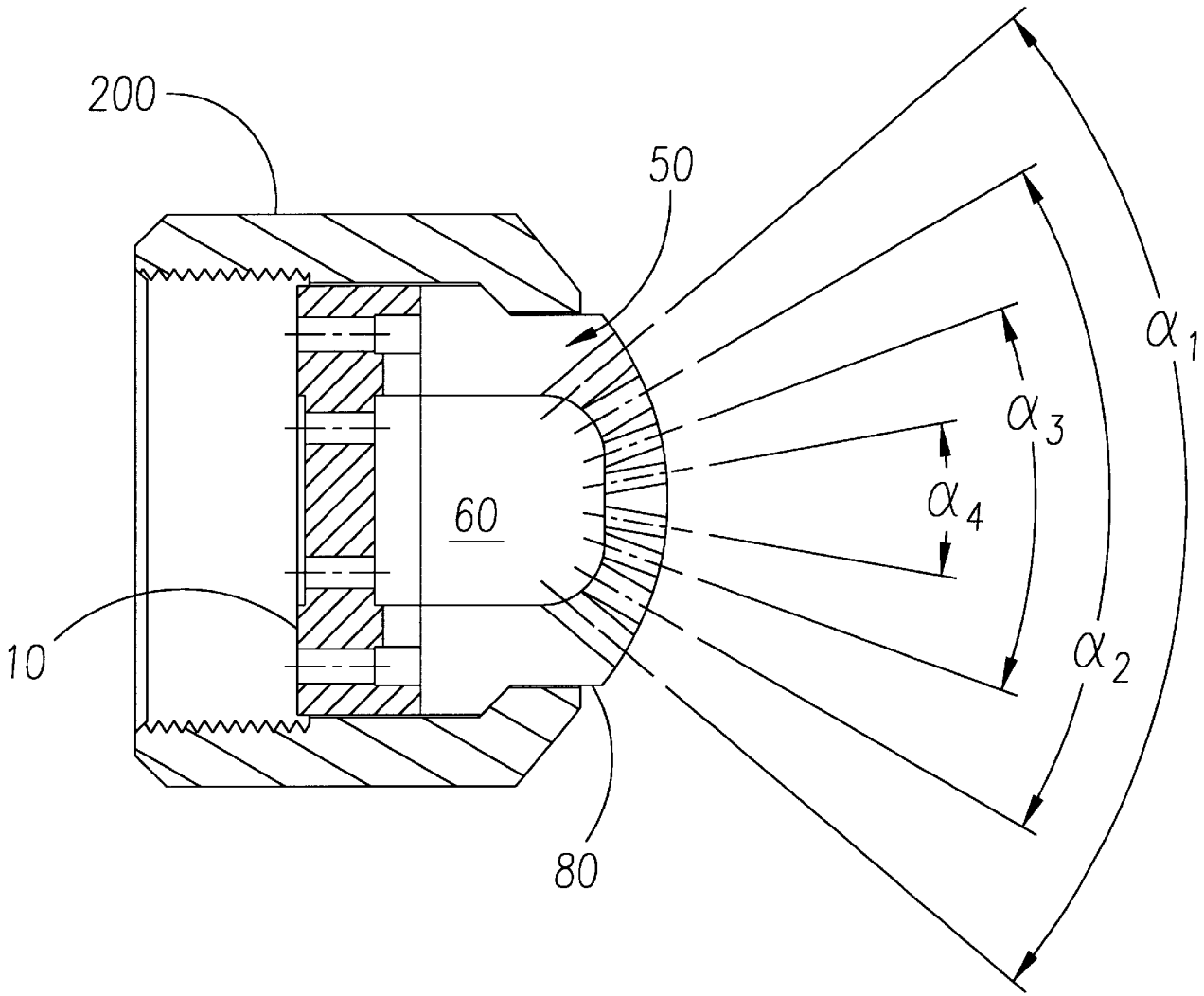
FIG. 3 shows spray angles of a fuel oil atomizer of the present invention.

In a preferred embodiment as shown in FIGS. 2 and 3, the plurality of sprayer plate openings 70 comprise four sets of openings 72, 74, 76, and 78. A first set of openings 72 has a first dimension 92 and is arranged on an first annulus 82 of the outer wall 80 of the sprayer plate 50 for expelling atomized fuel at a first spray angle $\alpha_1$. A second set of openings 74 has a second dimension 94 and is arranged on a second annulus 84 of the outer wall 80 of the sprayer plate 50 for expelling atomized fuel at a second spray angle $\alpha_2$. A third set of openings 76 has a third dimension 96 and is arranged on a third annulus 86 of the outer wall 80 of the sprayer plate 50 for expelling atomized fuel at a third spray angle $\alpha_3$. A fourth set of openings 78 has a fourth dimension 98 and is arranged on a fourth annulus 88 of the outer wall 80 of the sprayer plate 50 for expelling atomized fuel at a fourth spray angle $\alpha_4$.

The first dimension 92, second dimension 94, third dimension 96 and fourth dimension 98 may be successively smaller dimensions. In the embodiment illustrated in FIG. 2, the first annulus 82, second annulus 84, third annulus 86, and fourth annulus 88 are arranged on successively smaller annuli of the outer wall 80. The first spray angle $\alpha_1$, second spray angle $\alpha_2$, third spray angle $\alpha_3$, and fourth spray angle $\alpha_4$ as illustrated in FIG. 3 may be successively smaller spray angles.

The first set of openings 72 may comprise two series of equally spaced openings 72*a* and 72*b*, one series of openings arranged at a top portion of the first annulus 82 and the other series of openings arranged at a bottom portion of the first annulus 82. The second set of openings 74 may comprise two series of equally spaced openings 74*a* and 74*b*, one series of openings arranged at a top portion of the second annulus 84 and the other series of openings arranged at a bottom portion of the second annulus 84. The third set of openings 76 may comprise two series of equally spaced openings 76*a* and 76*b*, one series of openings arranged at a top portion of the third annulus 86 and the other series of openings arranged at a bottom portion of the third annulus 86. The fourth set of openings 78 may comprise two series of equally spaced openings 78*a* and 78*b*, one series of openings arranged at a top portion of the fourth annulus 88 and the other series of openings arranged at a bottom portion of the fourth annulus 88. It should be appreciated that the words "top" and "bottom" in the above text are for purposes of explanation only, and are used in relation to the drawings. The use of these terms is not intended to limit the structure of the atomizer itself, which may, of course, have any orientation in actual use.

The first spray angle al of the first set of openings 72 may be in the range of approximately 80 to 90 degrees. The second spray angle $\alpha_2$ of the second set of openings 74 may be approximately 60 degrees. The third spray angle $\alpha_3$ of the third set of openings 76 may be approximately 40 degrees. The fourth spray angle $\alpha_4$ of the fourth set of openings 78 may be approximately 20 degrees.

Each series of openings 72*a* and 72*b* of the first set of openings 72 may have a first total angular separation $\phi_1$. Each series of openings 74*a* and 74*b* of the second set of openings 74 may have a second total angular separation $\phi_2$ Each series of openings 76*a* and 76*b* of the third set of openings 76 may have a third total angular separation $\phi_3$. The first total angular separation $\phi_1$ may be approximately 105 degrees. The second total angular $\phi_2$ separation may be approximately 26 degrees. The third total angular separation $\phi_3$ may be approximately 36 degrees. Each series of openings 78*a* and 78*b* of the fourth set of openings 78 may comprise a single opening.

The first set of openings 72 may comprise approximately 66% of total hole flow area of the sprayer plate 50. The second set of openings 74 may comprise approximately 20% of the total hole flow area of the sprayer plate 50. The third set of openings 76 may comprise approximately 10% of the total hole flow area of the sprayer plate. The fourth set of openings 78 may comprise approximately 4% of the total hole flow area of the sprayer plate.

The mixing chamber 60 may preferably have a chamber length ($L=L_1+L_2$) to chamber diameter (D) in the range of approximately 0.75:1 to 1.25:1. The dimension L defines the front to back length of the mixing chamber, which is formed by cavity 54 of the sprayer plate 50 and the inner portion 16 of the mixing plate 10. $L_1$ denotes the length of the cavity 54 and $L_2$ denotes the length of a cavity outlined by the inner circumference of the plurality of wedge shaped portions 41 arranged on the inner portion 16 of the mixing plate 10. Although it is not apparent from the perspective view of the sprayer plate 50 shown in FIG. 1, it should be appreciated that the cavity 54 of the sprayer plate 50 is open ended and is not bounded by the first wall 52 of the sprayer plate 50. The enclosed mixing chamber 60 is formed when the mixing plate 10 is mated to the sprayer plate 50.

It is noted that the various dimensions and numerical relationships given herein are illustrative of a preferred embodiment, and that other dimensions can be used in accordance with the invention.

As shown in FIG. 1, the mixing plate 10 may further comprise a plurality of metering slots 40 arranged on an inner portion of the mixing plate 10. The metering slots 40 couple the distributor openings 20 with the central openings 30.

As discussed above, the first material (introduced via distributor openings 20) may be fuel oil and the second material (introduced via central openings 30) may an atomizing media, such as steam or air. In such a configuration, the total geometric area ratio of all central openings 30 to all metering slots 40 is preferably in a range from about 0.6:1 to 0.8:1. In the alternative, the first material may be an atomizing media and the second material may be fuel oil. In such a configuration, the total geometric area ratio of all central openings 30 to all metering slots 40 is preferably in a range of about 1.2:1 to 1.7:1.

The total area ratio of all distributor openings 20 to all metering slots 40 is preferably at least 1.7:1. However, the total area ratio of all distributor openings 20 to all metering slots 40 should be at least 1.7:1 and not greater than approximately 3:1.

In an alternate embodiment, the plurality of distributor openings 20 may be arranged on an outer annulus 12 of the mixing plate 10 and may extend through the mixing plate 10. The plurality of central openings 30 may be arranged on an inner annulus 14 of the mixing plate 10 and may extend through the mixing plate 10. The plurality of metering slots 40 couple the outer annulus with the inner annulus.

In a preferred embodiment, the mixing plate 10 has an outer portion 18 and an inner portion 16. A plurality of distributor openings 20 are arranged on an outer annulus 12 of the mixing plate 10 and extend through the mixing plate 10. A plurality of central openings 30 is arranged on an inner annulus 14 of the mixing plate 10 and extends through the mixing plate 10. A plurality of metering slots 40 is arranged on the inner portion 16 of the mixing plate. The metering slots couple the outer annulus 12 with the inner annulus 14.

The sprayer plate 50 in the preferred embodiment has a first wall 52 for engaging a portion of the inner portion 16 of the mixing plate 10, such that a first material traveling through the distributor openings 20 is forced into the metering slots 40 for mixture with a second material traveling through the central openings 30. The sprayer plate 50 may also have a semi-spherical outer wall 80 extending from the first wall 52 and a formed cavity 54. A plurality of sprayer plate openings 70 extending through the outer wall 80 of the sprayer plate 50 may also be provided to enable atomized fuel to be expelled from the sprayer plate openings 70. The plurality of sprayer plate openings 70 comprise four sets of openings 72, 74, 76, and 78. In the preferred embodiment, the four sets of openings 72, 74, 76, and 78 have all the features discussed above in connection with FIGS. 1, 2, and 3.

In the preferred embodiment, an enclosed mixing chamber 60 is formed by the mixing plate 10 and the sprayer plate cavity 54 for mixing the first material traveling through the distributor openings 20 with the second material traveling through the central openings 30.

The sprayer plate 50 and mixing plate 10 are coupled together in any suitable fashion. For example, FIG. 3 shows the mixing plate 10 coupled to the sprayer plate 50 by retaining nut 200. The mixing plate 10 and sprayer plate 50 may also be joined together using screws, bolts, welds, or the like. In addition, the mixing plate 10 and sprayer plate 50 may be formed as a single component.

The metering slots 40 may be formed by wedge shaped portions 41 of the inner portion 16 of the mixing plate. The wedge shaped portions 41 may have a larger dimension at the outer annulus 12 than at the inner annulus 14.

The atomized fuel may be expelled from the plurality of sprayer plate openings 70 at a variety of spray angles $\alpha$. The atomized fuel may be expelled in a spray pattern having distinct rich and lean fuel zones. The staging of the atomized fuel as it exits the sprayer plate 50 with the surrounding combustion chamber air provides a fuel/air ratio distribution that is appropriately rich and lean such that the flame temperature in the combustion chamber into which the atomizer ejects the fuel mixture is lowered. This lower flame temperature reduces NOx emissions. With atomized fuel droplet size small enough to enable rapid evaporation and complete combustion, minimum CO and particulate generation is achieved with a minimum excess oxygen level required. A low oxygen level also prevents the conversion of organically bound fuel nitrogen to NOx and the fuel staging provides reduced flame temperature that substantially reduces thermally generated NOx. The atomized fuel oil is comprised of fuel droplets which are sufficiently small to completely burn in the combustion chamber, thus reducing or eliminating particulate emission levels.

Figure 4:
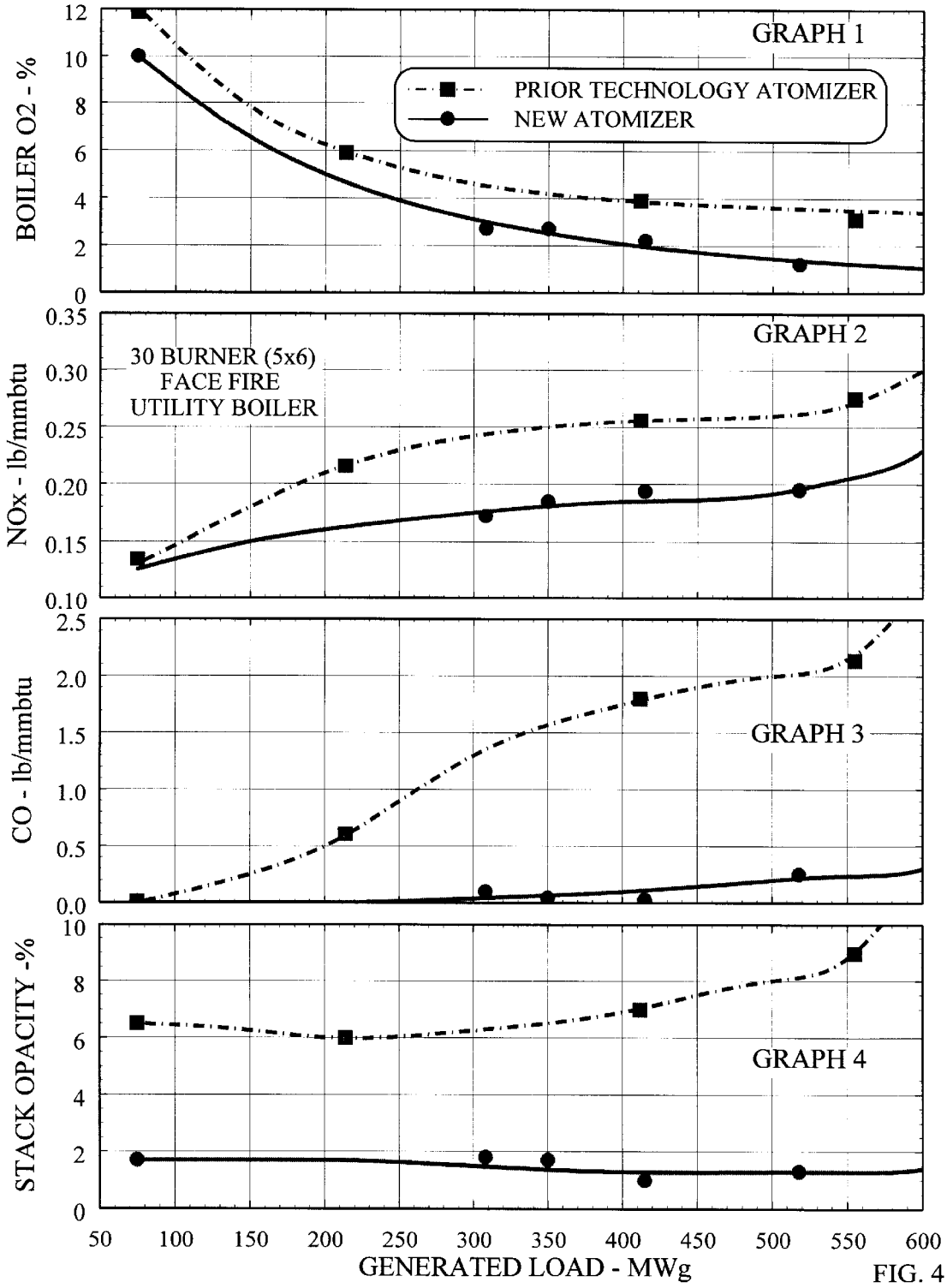
FIG. 4 shows graphical data comparing NOx, CO and opacity emissions as well as excess $O_2$ operating levels of a prior art fuel oil atomizer and the fuel oil atomizer of the present invention.

FIG. 4 shows experimental results from the fuel oil atomizer in a 600 megawatt (MW) utility furnace. The NOx emission reduction provided by the fuel oil atomizer of the present invention is in excess of 20% to 40% depending upon furnace load. The performance of the prior art atomizer is shown in dashed lines in each of the graphs and the performance of the atomizer of the present invention is shown in solid lines. Graph 1 shows the percentage of excess oxygen utilized by the furnace using both the prior art and the inventive atomizer. Graph 2 shows NOx emissions generated by both the prior art and inventive atomizers. Graph 3 shows the CO emissions generated by both the prior art and inventive atomizers. Graph 4 shows the opacity of the emissions generated by both the prior art and inventive atomizers. As is shown in each graph, the inventive atomizer provides for greatly reduced emissions while using substantially less oxygen than the prior art atomizer.

It will now be appreciated that the present invention provides an improved method and apparatus for atomizing fuel oil which provide reduced NOx emissions, while also improving or maintaining CO, PM and opacity generation.

Although the invention has been described in connection with preferred embodiments thereof, those skilled in the art will appreciate that numerous adaptations and modifications may be made thereto without departing from the spirit and scope of the invention, as set forth in the claims.

What is claimed is:

1. A fuel oil atomizer, comprising:

(a) a mixing plate having a plurality of distributor openings for receiving a first material and a plurality of central openings for receiving a second material; and (b) a sprayer plate adapted to engage said mixing plate to force said first material to mix with said second material, said sprayer plate comprising:

an enclosed mixing chamber formed by the mixing plate and a cavity of the sprayer plate for mixing said first material traveling through said mixing plate with said second material traveling through said mixing plate; and at least three sets of sprayer plate openings extending through a semi-spherical outer wall of said sprayer plate to enable atomized fuel to be expelled from the mixing chamber, each set of openings having different respective dimensions and being arranged on different respective annuli of the outer wall of said sprayer plate for expelling atomized fuel at different respective spray angles.

2. An atomizer in accordance with claim 1, wherein:

the respective dimensions of each set of openings are successively smaller dimensions;

the respective annuli are successively smaller annuli; and the respective spray angles are successively smaller spray angles.

3. An atomizer in accordance with claim 1, wherein the at least three sets of sprayer plate openings comprises:

a first set of openings having a first dimension and arranged on a first annulus of the outer wall of said sprayer plate for expelling atomized fuel at a first spray angle;

a second set of openings having a second dimension and arranged on a second annulus of the outer wall of said sprayer plate for expelling atomized fuel at a second spray angle;

a third set of openings having a third dimension and arranged on a third annulus of the outer wall of said sprayer plate for expelling atomized fuel at a third spray angle; and a fourth set of openings having a fourth dimension and arranged on a fourth annulus of the outer wall of said sprayer plate for expelling atomized fuel at a fourth spray angle.

4. An atomizer in accordance with claim 3, wherein:

said first dimension, second dimension, third dimension and fourth dimension are successively smaller dimensions;

said first annulus, second annulus, third annulus, and fourth annulus are arranged on successively smaller annuli of the outer wall; and said first spray angle, second spray angle, third spray angle, and fourth spray angle are successively smaller spray angles.

5. An atomizer in accordance with claim 3, wherein:

the first set of openings comprises two series of equally spaced openings, one series of openings arranged at a top portion of the first annulus and the other series of openings arranged at a bottom portion of the first annulus;

the second set of openings comprises two series of equally spaced openings, one series of openings arranged at a top portion of the second annulus and the other series of openings arranged at a bottom portion of the second annulus;

the third set of openings comprises two series of equally spaced openings, one series of openings arranged at a top portion of the third annulus.and the other series of openings arranged at a bottom portion of the third annulus; and the fourth set of openings comprises two series of equally spaced openings, one series of openings arranged at a top portion of the fourth annulus and the other series of openings arranged at a bottom portion of the fourth annulus.

6. An atomizer in accordance with claim 5, wherein:

the first spray angle of the first set of openings is in the range of approximately 80 to 90 degrees;

the second spray angle of the second set of openings is approximately 60 degrees;

the third spray angle of the third set of openings is approximately 40 degrees; and the fourth spray angle of the fourth set of openings is approximately 20 degrees.

7. An atomizer in accordance with claim 5, wherein:

each series of openings of the first set of openings has a first total angular separation;

each series of openings of the second set of openings has a second total angular separation;

each series of openings of the third set of openings has a third total angular separation.

8. An atomizer in accordance with claim 7, wherein:

the first total angular separation is approximately 105 degrees;

the second total angular separation is approximately 26 degrees;

the third total angular separation is approximately 36 degrees; and each series of openings of the fourth set of openings comprises a single opening.

9. An atomizer in accordance with claims 3, wherein;

the first set of openings comprises approximately 66% of total hole flow area of the sprayer plate;

the second set of openings comprises approximately 20% of the total hole flow area of the sprayer plate;

the third set of openings comprises approximately 10% of the total hole flow area of the sprayer plate; and the fourth set of openings comprises approximately 4% of the total hole flow area of the sprayer plate.

10. An atomizer in accordance with claim 1, wherein the mixing chamber has a chamber length to chamber diameter ratio in a range of about 0.75:1 to 1.25:1.

11. An atomizer in accordance with claim 1, wherein the mixing plate further comprises:

a plurality of metering slots arranged on an inner portion of said mixing plate and coupling said distributor openings with said central openings.

12. An atomizer in accordance with claim 11, wherein:

the first material is fuel;

the second material is an atomizing media; and the total geometric area ratio of all central openings to all metering slots is in a range from about 0.6:1 to 0.8:1.

13. An atomizer in accordance with claim 11, wherein:

the first material is an atomizing media;

the second material is fuel; and the total geometric area ratio of all central openings to all metering slots is in a range of about 1.2:1 to 1.7:1.

14. An atomizer in accordance with claim 11, wherein the total area ratio of all distributor openings to all metering slots is at least 1.7:1.

15. An atomizer in accordance with claim 11, wherein the total area ratio of all distributor openings to all metering slots is at least 1.7:1 and not greater than 3:1.

16. An atomizer in accordance with claim 11, wherein:

the plurality of distributor openings are arranged on an outer annulus of said mixing plate and extend through said mixing plate;

the plurality of central openings are arranged on an inner annulus of said mixing plate and extend through said mixing plate; and the plurality of metering slots couple said outer annulus with said inner annulus.

17. A fuel oil atomizer, comprising:

(a) a mixing plate having an outer portion and an inner portion, said mixing plate comprising:

a plurality of distributor openings arranged on an outer annulus of said mixing plate and extending through said mixing plate;

a plurality of central openings arranged on an inner annulus of said mixing plate and extending through said mixing plate;

a plurality of metering slots arranged on the inner portion of said mixing plate and coupling said outer annulus with said inner annulus;

(b) a sprayer plate comprising:

a first wall for engaging a portion of the inner portion of said mixing plate such that a first material traveling through the distributor openings is forced into the metering slots for mixture with a second material traveling through the central openings;

a semi-spherical outer wall extending from said first wall and forming a cavity;

a plurality of sprayer plate openings extending through said outer wall of said sprayer plate to enable atomized fuel to be expelled therefrom, said plurality of sprayer plate openings comprising:

a first set of openings having a first dimension and arranged on an first annulus of the outer wall of said sprayer plate for expelling atomized fuel at a first spray angle;

a second set of openings having a second dimension and arranged on a second annulus of the outer wall of said sprayer plate for expelling atomized fuel at a second spray angle;

a third set of openings having a third dimension and arranged on a third annulus of the outer wall of said sprayer plate for expelling atomized fuel at a third spray angle;

a fourth set of openings having a fourth dimension and arranged on a fourth annulus of the outer wall of said sprayer plate for expelling atomized fuel at a fourth spray angle; and an enclosed mixing chamber formed by the mixing plate and the sprayer plate cavity for mixing said first material traveling through said distributor openings with said second material traveling through said central openings.

18. An atomizer in accordance with claim 17, wherein:

said first dimension, second dimension, third dimension and fourth dimension are successively smaller dimensions;

said first annulus, second annulus, third annulus, and fourth annulus are arranged on successively smaller annuli of the outer wall; and said first spray angle, second spray angle, third spray angle, and fourth spray angle are successively smaller spray angles.

19. An atomizer in accordance with claim 17, wherein:

the first set of openings comprises two series of equally spaced openings, one series of openings arranged at a top portion of the first annulus and the other series of openings arranged at a bottom portion of the first annulus;

the second set of openings comprises two series of equally spaced openings, one series of openings arranged at a top portion of the second annulus and the other series of openings arranged at a bottom portion of the second annulus;

the third set of openings comprises two series of equally spaced openings, one series of openings arranged at a top portion of the third annulus and the other series of openings arranged at a bottom portion of the third annulus; and the fourth set of openings comprises two series of equally spaced openings, one series of openings arranged at a top portion of the fourth annulus and the other series of openings arranged at a bottom portion of the fourth annulus.

20. An atomizer in accordance with claim 19, wherein:

each series of openings of the first set of openings has a first total angular separation;

each series of openings of.the second set of openings has a second total angular separation;

each series of.openings of the.third set of openings has a third total angular separation; and each series of openings of the fourth set of openings has a fourth total angular separation.

21. A sprayer plate for use with a mixing plate to atomize fuel oil, comprising:

a first wall adapted to engage said mixing plate to force a first material to mix with a second material;

a cavity which forms an enclosed mixing chamber when said first wall is engaged with said mixing plate for mixing said first material with said second material; and at least three sets of sprayer plate openings extending through a semi-spherical outer wall of said sprayer plate to enable atomized fuel to be expelled from the mixing chamber, each set of openings having different respective dimensions and being arranged on different respective annuli of the outer wall of said sprayer plate for expelling atomized fuel at different respective spray angles.

22. A sprayer plate in accordance with claim 21, wherein:

the respective dimensions of each set of openings are successively smaller dimensions;

the respective annuli are successively smaller annuli; and the respective spray angles are successively smaller spray angles.

23. A sprayer plate in accordance with claim 21, wherein the at least three sets of sprayer plate openings comprises:

a first set of openings having a first dimension and arranged on an first annulus of the outer wall of said sprayer plate for expelling atomized fuel at a first spray angle;

a second set of openings having a second dimension and arranged on a second annulus of the outer wall of said sprayer plate for expelling atomized fuel at a second spray angle;

a third set of openings having a third dimension and arranged on a third annulus of the outer wall of said sprayer plate for expelling atomized fuel at a third spray angle; and a fourth set of openings having a fourth dimension and arranged on a fourth annulus of the outer wall of said sprayer plate for expelling atomized fuel at a fourth spray angle.

24. A sprayer plate in accordance with claim 23, wherein:

said first dimension, second dimension, third dimension and fourth dimension are successively smaller dimensions;

said first annulus, second annulus, third annulus, and fourth annulus are arranged on successively smaller annuli of the outer wall; and said first spray angle, second spray angle, third spray angle, and fourth spray angle-are successively smaller spray angles.

25. A sprayer plate in accordance with claim 23, wherein:

the first set of openings comprises two series of equally spaced openings, one series of openings arranged at a top portion of the first annulus and the other series of openings arranged at a bottom portion of the first annulus;

the second set of openings comprises two series of equally spaced openings, one series of openings arranged at a top portion of the second annulus and the other series of openings arranged at a bottom portion of the second annulus;

the third set of openings comprises two series of equally spaced openings, one series of openings arranged at a top portion of the third annulus and the other series of openings arranged at a bottom portion of the third annulus; and the fourth set of openings comprises two series of equally spaced openings, one series of openings arranged at a top portion of the fourth annulus and the other series of openings arranged at a bottom portion of the fourth annulus.

26. A sprayer plate in accordance with claim 25, wherein:

the first spray angle of the first set of openings is in the range of approximately 80 to 90 degrees;

the second spray angle of the second set of openings is approximately 60 degrees;

the third spray angle of the third set of openings is approximately 40 degrees; and the fourth spray angle of the fourth set of openings is approximately 20 degrees.

27. A sprayer plate in accordance with claim 25, wherein:

each series of openings of the first set of openings has a first total angular separation;

each series of openings of the second set of openings has a second total angular separation;

each series of openings of the third set of openings has a third total angular separation.

28. A sprayer plate in accordance with claim 27, wherein:

the first total angular separation is approximately 105 degrees;

the second total angular separation is approximately 26 degrees;

the third total angular separation is approximately 36 degrees; and each series of openings of the fourth set of openings comprises a single opening.

29. A sprayer plate in accordance with claim 23, wherein;

the first set of openings comprises approximately 66% of total hole flow area of the sprayer plate;

the second set of openings comprises approximately 20% of the total hole flow area of the sprayer plate;

the third set of openings comprises approximately 10% of the total hole flow area of the sprayer plate; and the fourth set of openings comprises.approximately 4% of the total hole flow area of the sprayer plate.

30. A sprayer plate in accordance with claim 21, wherein the mixing chamber has a chamber length to chamber diameter ratio in a range of about 0.75:1 to 1.25:1.

31. A mixing plate for use with a sprayer plate for atomizing fuel oil, comprising:

a plurality of distributor openings arranged on an outer annulus of said mixing plate and extending through said mixing plate;

a plurality of central openings arranged on an inner annulus of said mixing plate and extending through said mixing plate;

a plurality of metering slots arranged on an inner portion of said mixing plate and coupling said outer annulus with said inner annulus; wherein:

said inner portion of said mixing plate is adapted to engage said sprayer plate to form a mixing chamber such that a first material traveling through said distributor openings is forced through said metering slots to mix with a second material traveling through said central openings; and the sprayer plate comprises at least three sets of sprayer plate openings, each set of openings having different respective dimensions and being arranged on different respective annuli of an outer wall of said mixing chamber for expelling atomized fuel at different respective spray angles.

32. A mixing plate in accordance with claim 31, wherein the total area ratio of all distributor openings to all metering slots is at least 1.7:1.

33. A mixing plate in accordance with claim 31, wherein the total area ratio of all distributor openings to all metering slots is at least 1.7:1 and not greater than 3:1.

34. A mixing plate in accordance with claim 31, wherein said metering slots are formed by wedge shaped portions of the inner portion of said mixing plate having a larger dimension at the outer annulus than at the inner annulus.

35. A mixing plate in accordance with claim 31, wherein:

the first material is fuel;

the second material is an atomizing media; and the total geometric area ratio of all central openings to all metering slots is in a range from about 0.6:1 to 0.8:1.

36. A mixing plate in accordance with claim 31, wherein:

the first material is an atomizing media;

the second material is fuel; and the total geometric area ratio of all central openings to all metering slots is in a range of about 1.2:1 to 1.7:1.

37. A method for discharging atomized fuel oil, comprising the steps of:

mixing a fuel oil with an atomizing media in a mixing chamber to produce atomized fuel;

expelling atomized fuel from the mixing chamber through at least three sets of sprayer plate openings, said sprayer plate openings extending through a semi-spherical outer wall of said mixing chamber, each set of openings having different respective dimensions and being arranged on different respective annuli of said outer wall of said mixing chamber for expelling the atomized fuel at different respective spray angles.

38. A method in accordance with claim 37, wherein the atomized fuel is expelled in a spray pattern having distinct rich and lean fuel zones.

39. A method in accordance with claim 37, wherein the at least three sets of sprayer plate openings comprises:

a first set of openings having a first dimension and arranged on an first annulus of the outer wall of said sprayer plate for expelling atomized fuel at a first spray angle;

a second set of openings having a second dimension and arranged on a second annulus of the outer wall of said sprayer plate for expelling atomized fuel at a second spray angle;

a third set of openings having a third dimension and arranged on a third annulus of the outer wall of said sprayer plate for expelling atomized fuel at a third-spray angle; and a fourth set of openings having a fourth dimension and arranged on a fourth annulus of the outer wall of said sprayer plate for expelling atomized fuel at a fourth spray angle.

40. A method in accordance with claim 39, wherein:

said first dimension, second dimension, third dimension and fourth dimension are successively smaller dimensions;

said first annulus, second annulus, third annulus, and fourth annulus are arranged on successively smaller annuli of the outer wall; and said first spray angle, second spray angle, third spray angle, and fourth spray angle are successively smaller spray angles.

41. A method in accordance with claim 39, wherein:

the first set of openings comprises two series of equally spaced openings, one series of openings arranged at a top portion of the first annulus and the other series of openings arranged at a bottom portion of the first annulus;

the second set of openings comprises two series of equally spaced openings, one series of openings arranged at a top portion of the second annulus and the other series of openings arranged at a bottom portion of the second annulus;

the third set of openings comprises two series of equally spaced openings, one series of openings arranged at a top portion of the third annulus and the other series of openings arranged at a bottom -portion of the third annulus; and the fourth set of openings comprises two series of equally spaced openings, one series of openings arranged at a top portion of the fourth annulus and the other series of openings arranged at a bottom portion of the fourth annulus.

42. A method in accordance with claim 41, wherein:

the first spray angle of the first set of openings is in the range of approximately 80 to 90 degrees;

the second spray angle of the second set of openings is approximately 60 degrees;

the third spray angle of the third set of openings is approximately 40 degrees; and the fourth spray angle of the fourth set of openings is approximately 20 degrees.

43. A method in accordance with claim 41, wherein:

each series of openings of the first set of openings has a first total angular separation;

each series of openings of the second set of openings has a second total angular separation;

each series of openings of the third set of openings has a third total angular separation.

44. A method in accordance with claim 43, wherein:

the first total angular separation is approximately 105 degrees;

the second total angular separation is approximately 26 degrees;

the third total angular separation is approximately 36 degrees; and each series of openings of the fourth set of openings comprises a single opening.

45. A method in accordance with claim 39, wherein;

the first set of openings comprises approximately 66% of total hole flow area of the sprayer plate;

the second set of openings comprises approximately 20% of the total hole flow area of the sprayer plate;

the third set of openings comprises approximately 10% of the total hole flow area of the sprayer plate; and the fourth set of openings comprises approximately 4% of the total hole flow area of the sprayer plate.

* * * * *